US009777562B2

(12) United States Patent
Lastra et al.

(10) Patent No.: US 9,777,562 B2
(45) Date of Patent: Oct. 3, 2017

(54) METHOD OF USING CONCENTRATED SOLAR POWER (CSP) FOR THERMAL GAS WELL DELIQUIFICATION

(71) Applicant: Saudi Arabian Oil Company, Dhahran (SA)

(72) Inventors: Rafael Adolfo Lastra, Dhahran (SA); Abubaker Saeed, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 247 days.

(21) Appl. No.: 14/018,899

(22) Filed: Sep. 5, 2013

(65) Prior Publication Data

US 2015/0060073 A1 Mar. 5, 2015

(51) Int. Cl.
*E21B 43/12* (2006.01)
*E21B 43/24* (2006.01)

(52) U.S. Cl.
CPC ..... *E21B 43/24* (2013.01); *E21B 43/12* (2013.01)

(58) Field of Classification Search
CPC ..... E21B 43/24; E21B 43/12; E21B 36/005; F24J 2/04; F24J 2002/04
See application file for complete search history.

(56) References Cited

U.S. PATENT DOCUMENTS 3,493,050 A 2/1970 Kelley et al.
3,938,592 A * 2/1976 Aladiev ..... E21B 43/24 166/299
4,110,628 A 8/1978 Paull et al.
4,120,357 A * 10/1978 Anderson ..... E21B 36/00 166/245
4,299,200 A * 11/1981 Spencer ..... 126/584
4,513,733 A 4/1985 Braun
4,611,654 A * 9/1986 Buchsel ..... F24D 11/003 126/636
4,714,108 A * 12/1987 Barry ..... F24J 3/083 165/142

(Continued)

FOREIGN PATENT DOCUMENTS

CN 203097859 U 7/2013
FR 2901838 A1 12/2007

(Continued)

OTHER PUBLICATIONS

Rankine Cycle, available at http://www.thermopedia.com/content/1072 (last accessed: Jul. 8, 2015) (last modified: Feb. 7, 2011).*

(Continued)

*Primary Examiner* — Angela M DiTrani
*Assistant Examiner* — Andrew H Sue-Ako
(74) *Attorney, Agent, or Firm* — Bracewell LLP; Constance G. Rhebergen; Kevin R. Tamm

(57) ABSTRACT

A concentrated solar power (CSP) deliquification system for discouraging the accumulation of liquids in a wellbore includes a CSP heating subsystem, and an injection and recirculation subsystem. A working fluid is heated by the CSP heating subsystem and conveyed down-hole into the wellbore by the injection and recirculation subsystem. Heat is transferred from the working fluid to a production fluid within the wellbore, which facilitates maintenance of the production fluid in a gaseous or phase while in the wellbore.

16 Claims, 3 Drawing Sheets

(56) References Cited

U.S. PATENT DOCUMENTS

| | | | | |
|---|---|---|---|---|
| 5,114,318 | A * | 5/1992 | Freeborn | F03G 6/00 417/379 |
| 5,509,479 | A | 4/1996 | Emmons | |
| 5,706,888 | A * | 1/1998 | Ambs | F24J 3/081 165/103 |
| 5,803,161 | A * | 9/1998 | Wahle | F28D 15/0233 165/104.21 |
| 5,911,278 | A | 6/1999 | Reitz | |
| 7,407,003 | B2 * | 8/2008 | Ross | 165/295 |
| 7,472,548 | B2 | 1/2009 | Meksvanh et al. | |
| 7,546,870 | B1 | 6/2009 | Dotson | |
| 8,167,027 | B2 * | 5/2012 | Liebel | F24J 3/083 165/155 |
| 8,327,681 | B2 | 12/2012 | Davidson et al. | |
| 2001/0032663 | A1 | 10/2001 | Pelrine et al. | |
| 2002/0018697 | A1 * | 2/2002 | Vinegar | B09C 1/062 405/128.55 |
| 2002/0100587 | A1 * | 8/2002 | Lewis | 166/303 |
| 2004/0031585 | A1 * | 2/2004 | Johnson, Jr. | E21B 23/00 165/45 |
| 2006/0127226 | A1 | 6/2006 | Crawford | |
| 2007/0056726 | A1 * | 3/2007 | Shurtleff | E21B 43/305 166/245 |
| 2008/0023197 | A1 | 1/2008 | Shurtleff | |
| 2009/0000791 | A1 | 1/2009 | Ice | |
| 2009/0044952 | A1 | 2/2009 | Hunter | |
| 2009/0145608 | A1 | 6/2009 | Croteau | |
| 2009/0189617 | A1 * | 7/2009 | Burns et al. | 324/649 |
| 2011/0061873 | A1 * | 3/2011 | Patterson et al. | 166/369 |
| 2011/0067688 | A1 * | 3/2011 | Reif | F24J 2/06 126/600 |
| 2011/0120126 | A1 | 5/2011 | Srinivasan | |

FOREIGN PATENT DOCUMENTS

| | | | | |
|---|---|---|---|---|
| GB | 2449620 | A | 12/2008 | |
| WO | 2012006288 | A2 | 1/2012 | |
| WO | WO 2012006258 | * | 1/2012 | F24J 2/42 |

OTHER PUBLICATIONS

PCT International Search Report and the Written Opinion; dated Jan. 27, 2015; International Application No. PCT/US2014/051186; International File Date: Aug. 15, 2014.

Pigott et al. "Wellbore Heating to Prevent Liquid Loading" SPE Annual Technical Conference and Exhibition, SPE 77649, San Antonio, TX, Sep. 29, 2002-Oct. 2, 2002, pp. 1-10.

Veeken et al. "New Perspective on Gas-Well Liquid Loading and Unloading" SPE Annual Technical Conference and Exhibition, SPE 134483, Florence, Italy, Sep. 19-22, 2010, pp. 343-356.

* cited by examiner

METHOD OF USING CONCENTRATED SOLAR POWER (CSP) FOR THERMAL GAS WELL DELIQUIFICATION

BACKGROUND OF THE INVENTION

1. Field of the Invention

The present invention relates to operations in a wellbore associated with the production of hydrocarbons. More specifically, the invention relates to a system and method for reducing or preventing the occurrence of liquid loading in a natural gas wellbore.

2. Description of the Related Art

Often when natural gas is produced in a wellbore, condensation of liquids occurs as the natural gas expands within the wellbore and cools in transit to the surface. Free liquids such as oil and water in a geologic reservoir may also enter a wellbore along with the natural gas being produced. Initially, the natural gas stream in transit to the surface may carry these liquids up-hole by viscous drag forces. However, as reservoir pressure depletes in mature wellbores, the velocity of the gas stream is often reduced below a "critical velocity" that is required to carry the liquids to the surface. Thus, below the critical velocity, liquids begin to accumulate in the wellbore in a phenomena called "liquid loading." Liquid loading in a wellbore may inhibit the production of natural gas therefrom. For instance, accumulation of liquids increases the flowing bottom hole pressure, which may result in a cessation of production. Additionally, accumulated liquids may interact with an inner lining of production tubing, yielding corrosion and scaling.

Deliquification and liquid-unloading techniques may be employed to remove accumulated liquids from a wellbore. For example, submersible pumping systems may be installed in a wellbore, or techniques such as plunger lifting may be employed wherein a plunger is raised through the tubing of a wellbore to sweep liquids to the surface for removal. Typically, these procedures, which attempt to remove liquid that has already accumulated in a wellbore, are associated with relatively high operating costs and often require temporarily shutting down, or cycling the wellbore.

SUMMARY OF THE INVENTION

Described herein are systems and methods for reducing or preventing the accumulation of liquid in a wellbore. Solar power is concentrated to heat a working fluid, which is conveyed down-hole into the wellbore in a closed fluid conduit. Heat is transferred from the working fluid into a production fluid in the wellbore to maintain the production fluid in a gaseous or vapor phase. Maintenance of the production fluid in vapor phase avoids condensation associated with liquid loading and reduces the corrosive effects of the production fluid on the production tubing. The systems and methods described herein may be driven entirely by solar energy, which allows for relatively low maintenance costs, and which may significantly improve production rates and extend the production life of the well.

According to one aspect of the invention, a system for deliquifying a wellbore includes a concentrated solar power (CSP) heating subsystem operable to heat a working fluid by directing solar energy collected over a relatively large field into a relatively small area, and an injection and recirculation subsystem in fluid communication with the CSP heating subsystem. The injection and recirculation subsystem is operable to (a) receive the working fluid at a first temperature from the CSP heating subsystem, (b) convey the working fluid down-hole into a wellbore producing a production fluid, and return the working fluid up-hole in a closed fluid conduit, (c) enable heat transfer from the working fluid to the production fluid through the closed fluid conduit within the wellbore such that the working fluid is at a second temperature that is lower than the first temperature, and (d) convey the working fluid to the CSP heating subsystem at the second temperature for additional heating.

The closed fluid conduit may comprise a coiled tubing structure including first and second passageways arranged in a generally parallel manner encapsulated by a binder material. A return fixture may be coupled at a lower end of the coiled tubing structure to provide fluid communication between the first and second passageways, and the return fixture may comprise a u-shaped pipe connector. The coiled tubing structure may be disposed within a production tubing of the wellbore through which the production fluid is conveyed up-hole. At least one channel may be defined on an exterior surface of the binder material to facilitate heat transfer through the coiled tubing structure. The coiled tubing structure may extend to a depth within the wellbore at which perforations are provided for permitting entry of the production fluid into the wellbore.

At least one of a production tubing and a casing of the wellbore may be outfitted with a layer of thermally insulating material. The system may also include a fluid storage subsystem coupled between the CSP heating subsystem and the injection and recirculation subsystem. The fluid storage subsystem may include a high pressure storage tank having an input for receiving the working fluid from the CSP heating system and a low pressure storage tank having an input for receiving the working fluid from the injection and recirculation subsystem. A pressure differential may be maintained between the high pressure storage tank and the low pressure storage tank that is sufficient to drive the working fluid through the injection and recirculation system. A manifold may be coupled between the high pressure storage tank and the wellbore, and the manifold may be operable to control a flow rate of the working fluid through the injection and recirculation system. The system may also include a sensor package disposed within the wellbore. The sensor package may include at least one of a temperature sensor, flow rate sensor and a moisture sensor for detecting a parameter of either the working fluid or the production fluid in the wellbore. The sensor package may be in communication with the manifold.

A method of using the system to deliquify the wellbore may include (i) heating the working fluid with the CSP heating subsystem, (ii) conveying the working fluid down-hole into the wellbore and returning the working fluid to the CSP heating subsystem with the injection and recirculation subsystem, (iii) monitoring the wellbore for the presence of liquids in the production fluid, and (iv) adjusting a flow rate of the working fluid through the wellbore to permit sufficient heat to be transferred from the working fluid to the production fluid to maintain the production fluid in vapor form within the wellbore.

According to another aspect of the invention, a method of a discouraging the accumulation of liquids in a wellbore includes (i) collecting solar energy from a collection field, (ii) concentrating the solar energy into a relatively small area with respect to the collection field, (iii) heating a working fluid to a first temperature with the concentrated solar energy, (iv) conveying the working fluid at the first temperature into the wellbore, (v) cooling the working fluid to a second temperature within the wellbore by permitting heat transfer from the working fluid to a production fluid, and (vi) conveying the working fluid at the second temperature out of the wellbore.

The method may also include maintaining the working fluid within a closed conduit within the wellbore, and the step of conveying the working fluid at the first temperature into the wellbore may comprise conveying the working fluid at a flow rate sufficient to maintain the production fluid in vapor form within the wellbore. The method may also include monitoring the production fluid within the wellbore for the presence of liquids, and adjusting a flow rate of the working fluid into the wellbore to increase the heat transfer from the working fluid to the production fluid to reduce the presence of liquids in the production fluid.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
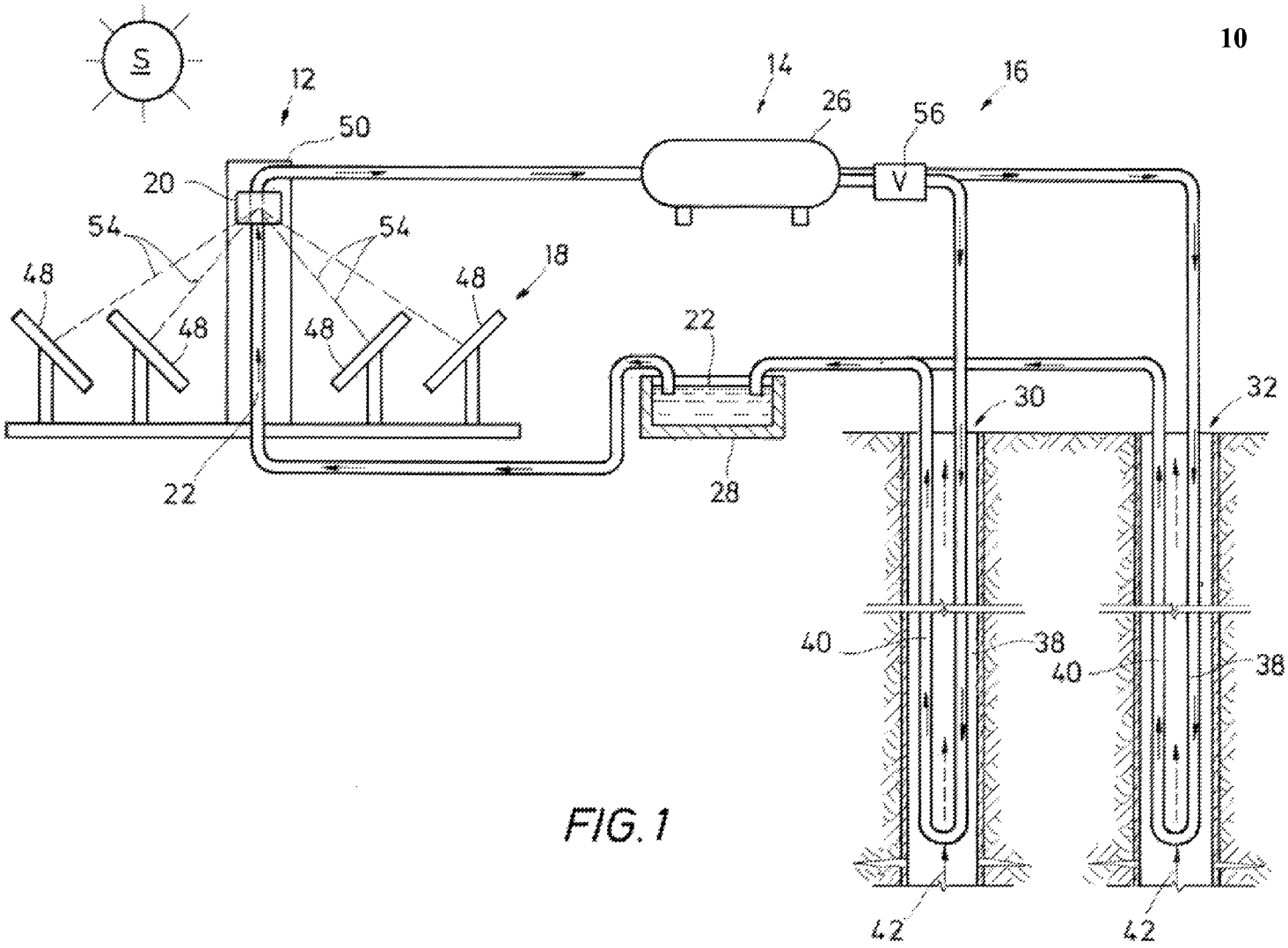
FIG. 1 is a schematic view of an example embodiment of a CSP deliquification system in accordance with the present invention including a CSP heating subsystem, a fluid storage subsystem, and an injection and recirculation subsystem.

Shown in side sectional view in FIG. 1 is one example embodiment of a concentrated solar power (CSP) deliquification system 10. The CSP deliquification system 10 is comprised of three main subsystems including a CSP heating subsystem 12, a fluid storage subsystem 14, and an injection and recirculation subsystem 16.

The CSP heating subsystem 12 generally captures solar energy from a generally broad collection field 18 and concentrates the solar energy into a relatively small area 20. A working fluid 22 moving through the small area 20 will be heated by the CSP heating subsystem 12. The working fluid 22 may comprise various substances such as oil, water, steam, molten salt, etc., and will flow to a high pressure storage tank 26, which is a component of the fluid storage subsystem 14.

The fluid storage subsystem 14 generally provides receptacles in which the working fluid 22 may accumulate as solar conditions and needs change. The high pressure storage tank 26 accumulates the working fluid 22 when solar energy is relatively abundant and maintains the working fluid 22 at a suitably high temperature and pressure for use by the injection and recirculation subsystem 16. A low pressure storage tank 28 accumulates the working fluid 22 used by injection and recirculation subsystem 16 when solar energy is relatively scarce. The fluid storage subsystem 14 thus ensures a sufficient quantity of the working fluid 22 is available for use by both the CSP heating subsystem 12 and the injection and recirculation subsystem 16.

The injection and recirculation subsystem 16 is coupled to both the high pressure storage tank 26 and the low pressure storage tank 28 of the fluid storage subsystem. The injection and recirculation subsystem 16 receives the working fluid 22 from the high pressure storage tank 26 and distributes the working fluid 22 to one or more wellbores 30, 32. The working fluid 22 flows down-hole into the wellbores 30, 32 through a respective injection line 38 and returns to the surface through a respective return line 40. The injection line 38 and return line 40 are thermally conductive such that heat may be conducted from the working fluid 22 passing therethrough into a production fluid 42 being produced from the wellbores 30, 32. The production fluid 42 is thus heated sufficiently to remain in vapor phase in transit to the surface. The working fluid 22 is cooled in the injection and recirculation subsystem 16, and deposited into the low pressure storage tank 26 where it is available for reheating by the CSP heating subsystem 12.

The CSP heating subsystem 12 includes a plurality of solar collectors 48 disposed over the generally broad collection field 18 and a receiver 50. In the example embodiment of FIG. 1, each of the solar collectors 48 include an arrangement of optics that direct incoming sunlight to form a beam 54, and steer the beam 54 toward the relatively small area 20 on the receiver 50. In one example embodiment, the solar collectors 48 include reflective surfaces, such as flat plate mirrors and Linear Frensel Reflectors (LFRs), to steer the beams 54 toward the receiver 50. In another example embodiment, the solar collectors 48 include converging or diverging optics, such as lenses and parabolic mirrors, to form, shape and steer the beams 54. In some embodiments, the solar collectors 48 may be stationary, and in other embodiments the solar collectors 48 may be configured to move to track the sun "S" as it moves across the sky during the day. In still other embodiments (not shown) solar collectors may be provided that include heat pipes or evacuated tubes with a heat transport medium inside. Typically, such collectors include a liquid inside the evacuated tube that will boil when heated, and will be induced to move in vapor form to a lower pressure portion of the tube. Heat may be extracted from the heat transport medium at a more desirable location for heating the working fluid 22.

In the example embodiment of FIG. 1, the receiver 50 supports the relatively small target area 20 in a position where each of the beams 54 converge. Solar energy from the beams 54 is absorbed into an absorption medium within the relatively small target area 20 to convert the solar energy to heat. In the example embodiment of FIG. 1, the absorption medium may include the working fluid 22 since the working fluid 22 passes through the relatively small target area 20. In other embodiments, heat may extracted from a separate absorption medium (not shown) that is disposed within the relatively small target area 20 and may be transferred to the working fluid 22 at a discrete location within the receiver 50.

The fluid storage subsystem 14 receives the heated working fluid from the CSP heating subsystem 12 in the high pressure storage tank 26. Although a single storage tank 26 is depicted in FIG. 1, the fluid storage system 14 may comprise any number and arrangement of interconnected storage receptacles. In some embodiments (not shown), drive elements such as pumps, venturi mechanisms, or other implements may be provided to assist the flow of working fluid 22 to the high pressure storage tank 26. In other embodiments, the high pressure storage tank 26 may be positioned and arranged such that the CSP heating 12 system imparts sufficient energy to the working fluid 22 to drive the working fluid 22 into the high pressure storage tank 26, and such that no additional energy, i.e., energy other than solar energy, is required to drive the CSP deliquification system 10.

The high pressure storage tank 26 maintains a supply of working fluid 22 at a sufficient first temperature and pressure. For example, where the working fluid 22 comprises steam, a temperature in the range of about 250-750° F. and a pressure of about 850 psi may be sufficient. The required temperatures and pressures are highly dependent on the particular application, but preferably a minimum pressure is maintained to overcome frictional losses of the working fluid 22 moving through the various conduits of the CSP deliquification system 10. A manifold 56 is provided at an outlet of the high pressure storage tank 26 to control the distribution of the working fluid 22 between one or more wellbores 30, 32. The manifold 56 may be adjustable to permit the working fluid 22 to flow exclusively through a single wellbore 30 or 32, or in an appropriate combination to supply sufficient heat to the wellbores 30, 32 while minimizing heat losses. The manifold 56 may also be adjustable to increase or decrease a flow rate of the working fluid 22.

Figure 2B:
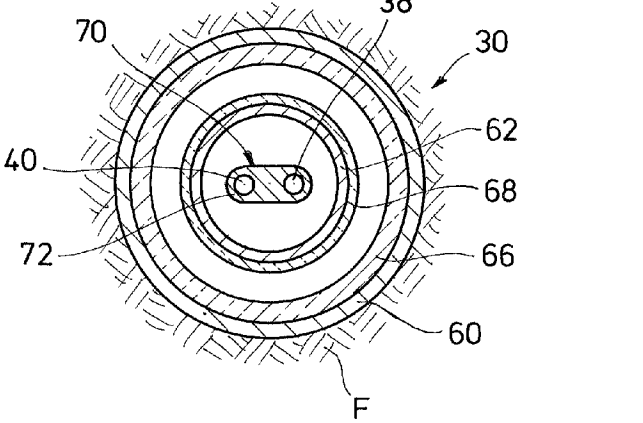
FIG. 2B is a cross-sectional view of the injection and recirculation subsystem installed in the wellbore of FIG. 2A taken along the line 2B-2B.
Figure 2A:
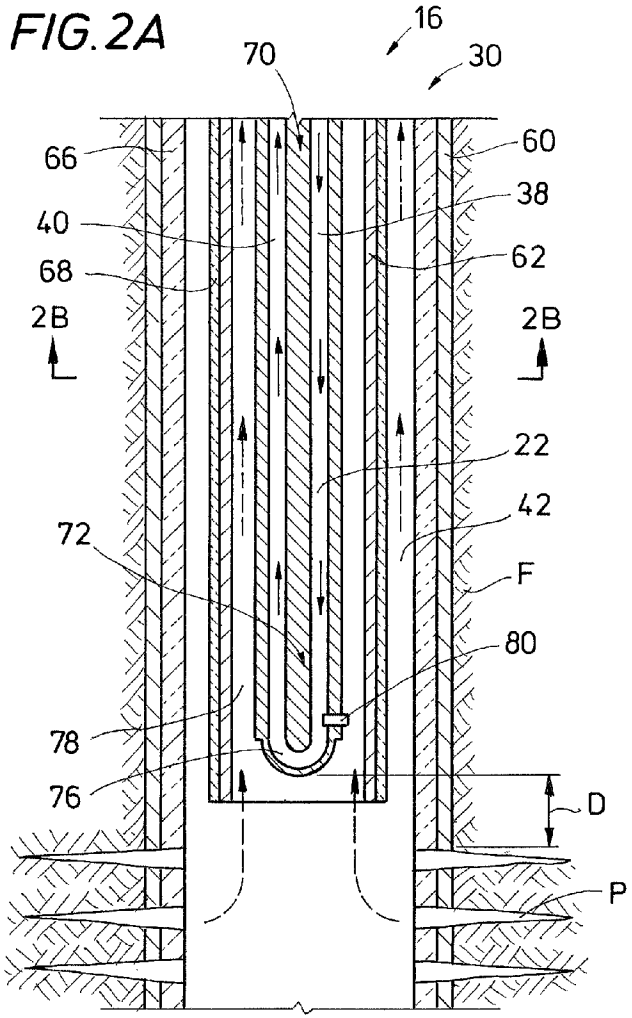
FIG. 2A is a partial, cross-sectional view of the injection and recirculation subsystem of FIG. 1 installed in a wellbore.

Referring now to FIGS. 2A and 2B, the injection and recirculation subsystem 16 receives the working fluid 22 in wellbore 30. The wellbore 30 extends through a subterranean formation "F," and is provided with a casing 60. Other embodiments (not shown) are contemplated for use in uncased wellbores, for example. Perforations "P" extend through the casing 60 and into the formation "F" so that production fluid 42 may enter the wellbore 30 from the surrounding formation "F." Production tubing 62 is provided through which the production fluid 42 may be conveyed up-hole to the surface. The casing 60 and the production tubing 62 and are each outfitted with a layer of thermally insulating material 66, 68 respectively, to limit heat losses from the wellbore 30 into the surrounding formation "F." The layers of thermally insulating material 66, 68 may include materials such as silica gels or foams, corrosion resistant polymers, or other suitable materials known in the art. As depicted in FIGS. 2A and 2B, the layers of thermally insulating material 66, 68 are both provided in an annulus defined between the casing 60 and the production tubing 62. However, as one skilled in the art will appreciate, the layers of thermally insulating material 66, 68 may be disposed in other locations such as within the production tubing 62 or between the casing 60 and the formation "F."

The injection line 38 and return line 40 are arranged in a generally parallel manner within a coiled tubing structure 70 extending within the production tubing 62. The coiled tubing structure 70 may be a commercially available product such as the FlatPak™ Tubing System available from CJS Production Technologies, or from other manufacturers. The coiled tubing structure 70 includes a flexible binder material 72, which encapsulates first and second passageways arranged in a generally parallel manner that form the injection line 38 and return line 40. Preferably, the binder material 72 exhibits a relatively high thermal conductivity such that heat may be readily transferred from the working fluid 22 to the production fluid 42 through the binder material 72. At a lower end of the coiled tubing structure 70, a return fixture 76 is installed to provide fluidic communication between the injection line 38 and return line 40.

As depicted in FIG. 2A, the return fixture 76 is U-shaped pipe connector. Together, the injection line 38, the return line 40 and the return fixture 76 define a closed fluid conduit 78 through which the working fluid 22 may flow substantially unencumbered. The working fluid 22 remains within the closed fluid conduit 78 and is not released into the wellbore 30. Other than frictional losses associated with the walls of the fluid conduit 78, the working fluid 22 is substantially unencumbered with resistance to flow by power extracting mechanisms such as fluid expanders or engines within the wellbore 30.

The return fixture 76 is located a distance "D" from the perforations "P" that extend into the subterranean formation "F." Generally the distance "D" will be zero or negative, i.e., the coiled tubing structure 70 will extend to a depth within the wellbore adjacent or beneath a production zone such that the production fluid 42 may be heated by the working fluid 22 throughout its passage to the surface. In some embodiments, the distance "D" will be positive. For example, in some stages of production, the production fluid 42 may contain enough heat upon emerging from the formation "F" to remain in vapor phase throughout a substantial portion of its passage to the surface, and thus additional heat provided by the working fluid 22 may only be necessary in upper portions of the wellbore 30.

A sensor package 80 may be provided at or near the return fixture 76 as depicted, at single or multiple other various locations along the coiled tubing structure 70, or at other locations generally within in the wellbore 30. The sensor package 80 may include temperature, pressure, moisture and/or flow rate sensors to detect parameters of both the working fluid 22 and the production fluid 42. Information derived from the sensor package 80 may be transmitted up-hole through electrical conduits (not shown) encapsulated in the coiled tubing structure 70, or by other means known in the art. The information may be used to control or automate portions of the CSP deliquification system 10. For example, the sensor package 80 may communicate with the manifold 56 (FIG. 1) such that the manifold 56 may automatically increase a flow rate of the working fluid 22 if a detected temperature or flow rate of the production fluid 42 falls below a predetermined value. Adjusting the flow rate of the working fluid 22 will correspondingly adjust the amount of heat that may be transferred from the working fluid to the production fluid 42 within the wellbore 30.

Figure 3:
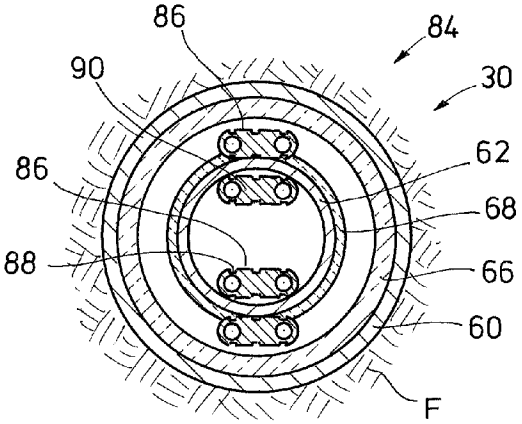
FIG. 3 is a cross-sectional view of an alternate embodiment of an injection and recirculation subsystem installed in the wellbore of FIG. 2B.

Referring now to FIG. 3, an alternate arrangement of an injection and recirculation system 84 is depicted within wellbore 30. Multiple installations of coiled tubing structures 86 are provided within the production tubing 62, as well as installations of coiled tubing structures 86 in an annulus located between the production tubing 62 and the casing 60. Channels 88 are formed in exterior surfaces of a binder material 90 of the coiled tubing structures 86. Channels 88 increase the surface area available for heat transfer between the installations of the coiled tubing structures 86 and their surroundings, and generally reduce the thermal resistance of the coiled tubing structures 86.

Figure 4:
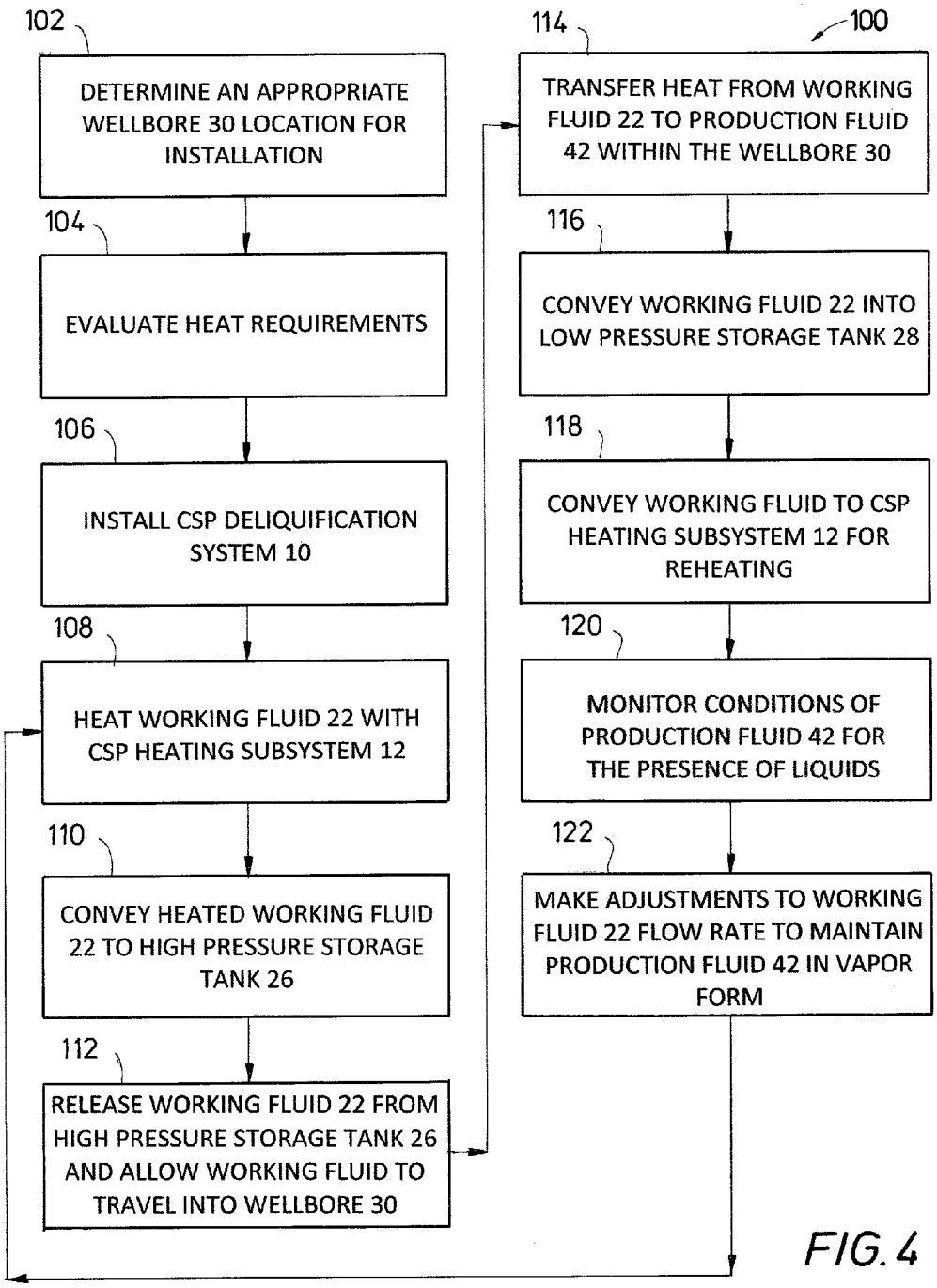
FIG. 4 is a flow diagram illustrating an example embodiment of an operational procedure in accordance with the present invention.

Referring now to FIG. 4, an operational procedure 100 for using the CSP deliquification system 10 is described. First, an appropriate wellbore location is determined for installation of the CSP deliquification system 10 (step 102). Candidate well locations may include wellbores in which liquid loading has been observed, or locations in which liquid loading may be expected in the absence of interventional operations. Next, the heat requirements for the selected wellbore 30 are evaluated (step 104) to determine the amount of heat necessary to maintain a production fluid 42 of the selected wellbore 30 in vapor form. Analysis of the production fluid 42 and the flow characteristics of the production fluid 42 at various depths within the wellbore 30 may be considered. The CSP deliquification system 10 is installed (step 106) to accommodate the heat requirements.

Once the CSP deliquification system 10 is installed, the CSP deliquification system 10 is operated to thermally treat the wellbore 30. The working fluid 22 is heated by the CSP heating subsystem (step 108) and conveyed to the high pressure storage tank 26 (step 110). Once a sufficient quantity, pressure and temperature of working fluid 22 has been supplied to the high pressure storage tank 26, the working fluid 22 is appropriately released into the wellbore 30 (step 112), e.g., through manifold 56 (FIG. 1). The working fluid 22 is conveyed into the wellbore 30 through the injection and recirculation subsystem 16 (FIG. 1) due to the pressure differential maintained between the high pressure storage tank 26 and the low pressure storage tank 28. Heat is transferred from the working fluid 22 to the production fluid 42 (step 114) as the working fluid moves within the wellbore 30. The working fluid 22 continues from the wellbore 30 to the low pressure storage tank 28 (step 116) where the working fluid 22 is stored until it may be conveyed to the CSP heating subsystem 12 for reheating (step 118).

The production fluid 42 may be monitored for the precipitation or condensation of liquids therefrom (step 120) within the wellbore 30, e.g., with the sensor package 80 (FIG. 2A). If liquids are detected in the production fluid 42, adjustments may be made to maintain the production fluid in vapor form within the wellbore 30 (step 122). For example, a flow rate of the working fluid 22 through the wellbore 30 may be increased to permit a greater amount of heat transfer from the working fluid 22 to the production fluid 42 within the wellbore 30. The steps 108, 110, 112, 114, 116, 118, 120 and 122 may be repeated continuously or as needed to prevent or reduce liquid loading in the wellbore 30.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for deliquifying a wellbore, the system comprising:

a concentrated solar power (CSP) heating subsystem operable to heat a working fluid by directing solar energy collected over a relatively large field into a relatively small area; and an injection and recirculation subsystem in fluid communication with the CSP heating subsystem, the injection and recirculation subsystem comprising a production tubing outfitted with a first layer of thermally insulating material, wherein an annulus is formed between the production tubing and a casing, wherein the casing is outfitted with a second layer of thermally insulating material, and wherein the injection and recirculation subsystem is operable to:

(a) receive the working fluid at a first temperature from the CSP heating subsystem in a first storage tank, the first storage tank positioned and arranged such that the CSP heating subsystem imparts sufficient energy to the working fluid to drive the working fluid into the first storage tank, and to maintain the working fluid at a suitably high temperature and pressure within the first storage tank for use by the injection and recirculation subsystem, the working fluid comprising steam in a temperature range of about 525° F. to about 750° F. and with a pressure of about 850 psi, and the suitably high temperature and pressure within the first storage tank being operable to overcome frictional losses of the working fluid while moving through the system for deliquifying the wellbore;

(b) convey the working fluid from the first storage tank down-hole a negative distance into a wellbore adjacent or beneath a production zone producing a production fluid and return the working fluid up-hole a positive distance to a second storage tank in a closed fluid conduit, the pressure differential between the first storage tank and the second storage tank conveying the working fluid downhole the negative distance and up-hole the positive distance, the negative distance and the positive distance disposed between the first storage tank and the second storage tank, without requiring additional energy other than solar energy;

(c) enable heat transfer from the working fluid to the production fluid throughout its passage to a surface through the closed fluid conduit within the wellbore such that the working fluid is at a second temperature that is lower than the first temperature, and such that liquid loading is reduced in the wellbore; and (d) conduct the working fluid to the CSP heating subsystem at the second temperature for additional heating, wherein the closed fluid conduit comprises a coiled tubing structure with an injection line and a return line arranged in a generally parallel and non-concentric configuration, the injection line and the return line having substantially the same diameters, the injection line and return line encapsulated by a binder material disposed around the length of both the injection line and the return line, and between the injection line and the return line, conjoining the injection line and return line along their lengths, where the binder material exhibits thermal conductivity to allow heat to be transferred from the working fluid to the production fluid through the binder material, and the injection line and the return line operable to thermally conduct heat through the binder directly to the production fluid continuously along the entire length of the injection line and return line, wherein the coiled tubing structure is disposed within the production tubing of the wellbore through which the production fluid is conveyed up-hole, and wherein the first and second layers of thermally insulating material limit heat losses from the production tubing into a formation proximate the wellbore.

2. The system of claim 1, further comprising a return fixture coupled at a lower end of the coiled tubing structure to provide fluid communication between the injection line and the return line.

3. The system of claim 2, wherein the return fixture comprises a u-shaped pipe connector.

4. The system of claim 1, wherein at least one channel is defined on an exterior surface of the binder material.

5. The system of claim 1, wherein the coiled tubing structure extends to a depth within the wellbore at which perforations extending into a surrounding formation are provided for permitting entry of the production fluid into the wellbore.

6. The system of claim 1, further comprising a manifold coupled between the first storage tank and the wellbore, the manifold operable to control a flow rate of the working fluid through the injection and recirculation subsystem.

7. The system of claim 1, further comprising a sensor package disposed within the wellbore, the sensor package including at least one of a temperature sensor, flow rate sensor and a moisture sensor for detecting a parameter of either the working fluid or the production fluid.

8. The system of claim 7, further comprising a manifold operable to control a flow rate of the working fluid through the injection and recirculation system, and wherein the sensor package is in communication with the manifold.

9. The system of claim 1, wherein the system is operable to provide heat between the working fluid and the production fluid through the injection line with a countercurrent flow between the working fluid and the production fluid.

10. The system of claim 1, wherein the annulus comprises at least one additional coiled tubing structure, the at least one additional coiled tubing structure comprising an injection line and a return line arranged in a generally parallel and non-concentric configuration, the injection line and the return line having substantially the same diameters, the injection line and return line encapsulated by a binder material disposed around the length of both the injection line and the return line, and between the injection line and the return line, conjoining the injection line and return line along their lengths, where the binder material exhibits thermal conductivity to allow heat to be transferred from the working fluid to the production fluid through the binder material.

11. A method of using the system of claim 1 to deliquify the wellbore, the method comprising:

heating the working fluid with the CSP heating subsystem;

conveying the working fluid down-hole into the wellbore and returning the working fluid to the CSP heating subsystem with the injection and recirculation subsystem;

monitoring the wellbore for the presence of liquids in the production fluid; and adjusting a flow rate of the working fluid through the wellbore to permit sufficient heat to be transferred from the working fluid to the production fluid to maintain the production fluid in vapor form.

12. A method of discouraging an accumulation of liquids in a wellbore, the method comprising:

(i) collecting solar energy from a collection field;

(ii) concentrating the solar energy into a relatively small area with respect to the collection field;

(iii) heating a working fluid to a first temperature with the concentrated solar energy, and storing the working fluid at the first temperature and at a first pressure, wherein the concentrated solar energy maintains the working fluid at a suitably high temperature and pressure for use by an injection and recirculation subsystem, the working fluid comprising steam in a temperature range of about 525° F. to about 750° F. and with a pressure of about 850 psi, the suitably high temperature and pressure being operable to overcome frictional losses of the working fluid while moving through a system for deliquifying a wellbore;

(iv) conveying the working fluid at the first temperature down-hole a negative distance into the wellbore through an injection line;

(v) cooling the working fluid to a second temperature within the wellbore by permitting heat transfer from the working fluid to a production fluid throughout the production fluid's passage to a surface, to reduce liquid loading in the wellbore;

(vi) conveying the working fluid at the second temperature a positive distance out of the wellbore in a return line by a pressure differential between a first storage tank and a second storage tank, the negative distance and the positive distance disposed between the first storage tank and the second storage tank, wherein no additional energy, other than solar energy, is required to convey the working fluid and wherein the injection line and the return line are arranged in a generally parallel, non-concentric configuration, the injection line and the return line having substantially the same diameters, the injection line and return line encapsulated by a binder material disposed around the length of both the injection line and the return line, and between the injection line and the return line, conjoining the injection line and return line along their lengths, where the binder material exhibits thermal conductivity to allow heat to be transferred from the working fluid to the production fluid through the binder material, and the injection line and the return line operable to thermally conduct heat through the binder directly to the production fluid continuously along the entire length of the injection line and return line, and (vii) preventing heat loss to a surrounding formation proximate the wellbore with at least two concentric layers of a thermally insulating material, wherein a first layer of thermally insulating material is outfitted on production tubing of the wellbore, the production tubing surrounding the injection line and the return line, and wherein a second layer of thermally insulating material is outfitted on a casing of the wellbore.

13. The method of claim 12, wherein the step of conveying the working fluid at the first temperature into the wellbore comprises conveying the working fluid at a flow rate sufficient to maintain the production fluid in vapor form within the wellbore.

14. The method of claim 12, further comprising:

monitoring the production fluid within the wellbore for the presence of liquids; and adjusting a flow rate of the working fluid into the wellbore to increase the heat transfer from the working fluid to the production fluid to reduce the presence of liquids in the production fluid.

15. The method of claim 12, wherein the step of cooling the working fluid to a second temperature within the wellbore by permitting heat transfer from the working fluid to a production fluid throughout the production fluid's passage to a surface, to reduce liquid loading in the wellbore, occurs, in part, by way of transferring heat from the working fluid to the production fluid through the injection line with a countercurrent flow between the production fluid and the working fluid.

16. The method of claim 12, wherein the step of preventing heat loss to a surrounding formation comprises the step of conveying working fluid in a coiled tubing structure into and out of the wellbore in an annulus between the first layer of thermally insulating material and the second layer of thermally insulating material.

* * * * *